United States Patent [19]

Kaiser

[11] 4,056,257

[45] Nov. 1, 1977

[54] HOISTING TACKLE BLOCK ASSEMBLY

[76] Inventor: Howard E. Kaiser, P.O. Box 85, Kettle Falls, Wash. 99141

[21] Appl. No.: 747,720

[22] Filed: Dec. 6, 1976

[51] Int. Cl.[2] ..... B66D 1/36

[52] U.S. Cl. ..... 254/194; 24/230.5 R; 74/230.3

[58] Field of Search ..... 254/192–197; 74/230.01, 230.3; 24/230.5

[56] References Cited

U.S. PATENT DOCUMENTS

| | | | |
|---|---|---|---|
| 312,682 | 2/1885 | Werum | 254/194 |
| 2,009,861 | 7/1935 | Skinner | 24/230.5 SS X |
| 2,546,445 | 3/1951 | Halvorsen et al. | 254/193 |
| 2,762,607 | 9/1956 | Anderson | 254/194 |

*Primary Examiner*—Robert J. Spar
*Assistant Examiner*—Donald W. Underwood
*Attorney, Agent, or Firm*—Wells, St. John & Roberts

[57] ABSTRACT

A hoisting tackle block assembly is described for receiving and accommodating a rope loop without having to thread a free end of the rope through the block housing and over a sheave. The assembly includes a shaft with a sleeve mounted for rotation about the shaft axis. The assembly includes two housing members mounted on shaft ends that extend alongside the sleeve and over the sheave terminating in upper connecting ends. The housing members are angularly movable with respect to each other to enable the housing member to be angularly displaced to enable a rope loop to be placed over the sheave. The housing members are then aligned with each other to enclose the rope loop for operation.

4 Claims, 4 Drawing Figures

HOISTING TACKLE BLOCK ASSEMBLY

BACKGROUND OF THE INVENTION

This invention relates to hoisting tackle and more particularly to hoisting tackle block assemblies utilized for lifting objects utilizing a rope or cable.

In loading a hoisting tackle block assembly with a rope, it is generally necessary to thread a free end of the rope over the tackle block sheave with the free end passing through an enclosed frame structure that extends over the top of the sheave. Not only is this time consuming but frequently it is necessary to either cut a continuous section of rope or open a loop to provide a free end. Likewise such hoisting tackle blocks are unable to accommodate closed rope loops since they do not have a free end.

One of the principal objects of this invention is to provide a hoisting tackle block assembly that is capable of accommodating or receiving a closed loop of a rope without having to provide a free rope end.

An additional object of this invention is to provide a hoisting tackle block assembly that may be very easily and quickly loaded with a rope.

A further object of this invention is to provide a hoist tackle block assembly that is very inexpensive to manufacture and is capable of being efficiently loaded with a rope section.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which.

DETAILED DESCRIPTION OF A PREFERRED EMBODIMENT

Figure 1:
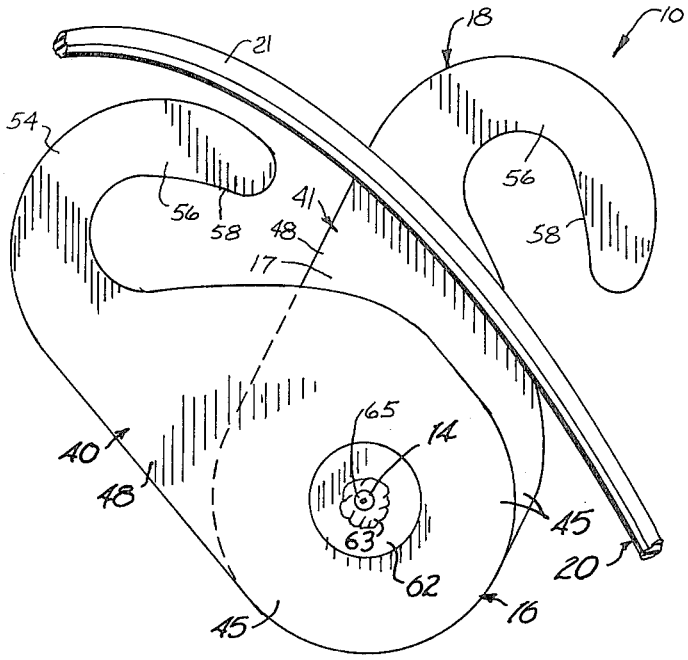
FIG. 1 is a side elevational view of the hoisting tackle block assembly embodying the principles of this invention in which the hoisting tackle block assembly is illustrated in an open or rope loading and unloading position with a rope loop being mounted onto the block assembly.
Figure 2:
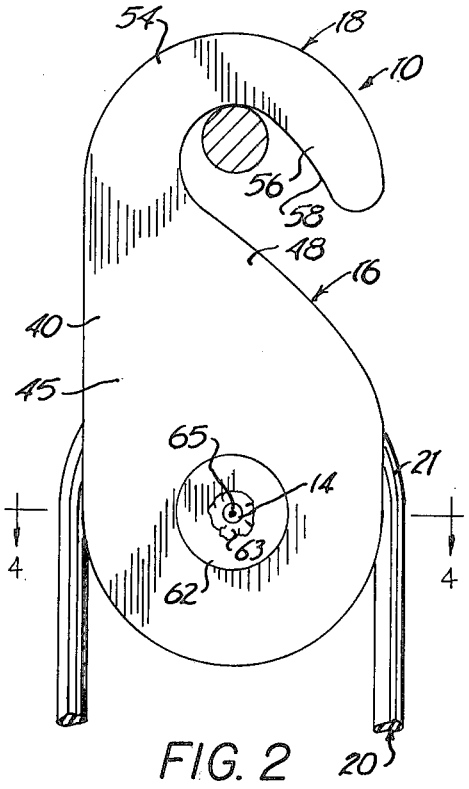
FIG. 2 is a side elevational view similar to FIG. 1 except showing the hoist tackle block assembly in the operative or closed position with a cable loop entrained in the assembly.

Referring now in detail to the drawings, there is illustrated in FIGS. 1 and 2 a hoisting tackle block assembly generally designated with the numeral 10 for receiving a hoisting rope 20 with a rope loop 21 being entrained on the block assembly. Generally the block assembly 10 includes a shaft 12 having a sheave 14 mounted thereon for rotation about the shaft axis. The block assembly 10 further includes a sheave housing 16 having an enclosable rope passageway 17 formed therein to enable the rope loop to be entrained through the housing and over the sheave 14. The housing 16 has a connecting means 18 for enabling the block assembly to be easily connected to an elevated support structure to facilitate the hoisting operation.

FIG. 1 shows the block assembly in the open or rope loading and unloading position with the passageway 17 open to enable the rope loop 21 to be easily mounted on the sheave 14 or removed from the sheave 14. FIG. 2 illustrates the block assembly 10 in the closed or operative position with the passageway 17 enclosed about the rope 20.

In more detail, the shaft 12 has ends 24 and 25. A grease passageway 27 is formed in the shaft 12 extending from end 25 longitudinally toward the center of the shaft and then radially outward opening on the periphery of the shaft intermediate the ends 24 and 25. The purpose of the passageway 27 is to receive grease and to pass the grease through the passageway to the periphery of the shaft for lubrication.

The sheave 14 has an annular radial body 30 with a shaft bore 31 therethrough for accommodating the shaft 12. The body 30 has sides 33 and 34 that extend outward from the shaft 12 to a grooved rim 36. In a preferred embodiment the sides 33 and 35 are substantially parallel with each other. The sheave 14 is mounted on the shaft 12 for rotation about the shaft 12 and the shaft axis.

The sheave housing 16 is constructed of two housing members 40 and 41 which are mirror images of each other. Preferably each housing member is a one piece unitary element. In a preferred embodiment, each of the housing members 40 and 41 is formed of plate material having a main body portion 45 with a shaft aperture 46 formed therein for receiving respective ends 24, 25 of the shaft 12. The main body portion 45 extends radially outward from athe shaft 12 to edges beyond the periphery of the sheave rim 36.

Each of the housing members 40 and 41 has an intermediate section 48 that extends upward and inward over the sheave 14. The intermediate section 48 includes a bend 50 that communicates with an upper end 54. In a preferred embodiment, the upper end portion 54 is parallel with the main body portion 45.

The upper ends 54 are formed in the shape of hook segments 56 that serve as the connecting means 18. Each of the hook segments 56 includes a hook opening 58. The hook openings 58 of both members 40 and 41 extend in the same angular direction with respect to the shaft axis.

In this preferred embodiment, housing member 41 is mounted on shaft end 24. The housing member 41 is affixed to the shaft end 24 by weld 60. The housing member 40 is mounted on the shaft end 25 for rotation with respect to the shaft 12. A washer 62 is mounted on the shaft end 25 outside of the housing member 40. The washer 62 is secured to the shaft end 25 by an annular weld 63.

A grease fitting 65 is mounted on the end 25 for supplying grease to the passageway 27.

Figure 3:
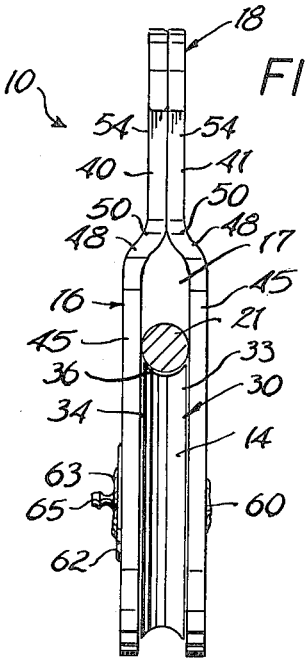
FIG. 3 is a front elevational view of the block assembly illustrated in FIG. 2.
Figure 4:
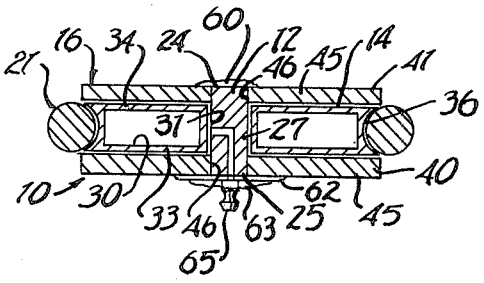
FIG. 4 is a cross-sectional view taken along line 4—4 in FIG. 2.

It is an important feature of this invention that the housing members 40 and 41 be capable of moving angularly about the axis of the shaft 12 with respect to each other. FIG. 1 illustrates the block assembly 10 as being in the open or rope loading or unloading position with the housing members 40 and 41 being angularly displaced with respect to each other about the axis of the shaft 12. In this configuration, the rope passageway 17 is open to enable the rope loop 21 to be passed between the two housing members 40 and 41 and onto the periphery of the sheave 14. To close the passageway 17 the housing members 40 and 41 are angularly displaced towards each other until they come into angular alignment with the upper ends 54 being flush with each other as illustrated in FIG. 2. In this condition the rope passageway 17 is enclosed as illustrated in FIG. 3 preventing the rope from "jumping" the sheave periphery. After the rope is loaded onto the sheave, the hook segments 56 may be connected to a supporting rod or the like extending from an elevated support structure.

The term rope is used in a generic sense to encompass the terms wire, cable, cord, strap, braid, twine, line and like terms which are used in the block and tackle art.

It should be understood that the above described embodiment is simply illustrative of the principles of this invention and that numerous other embodiments may be readily devised by those skilled in the art without deviating therefrom. Therefore only the following claims are intended to define this invention.

What is claimed is:

1. A hoisting tackle block assembly, comprising:

a sheave shaft;

a sheave mounted on the shaft for rotation about the shaft axis;

a first housing member supporting one end of the shaft and extending upward along one side of the sheave and over the sheave and terminating in an upper end;

a second housing member supporting the other end of the shaft and extending upward along the other side of the sheave and over the sheave and terminating in an upper end;

said upper ends of the housing members having complementary, angularly alignable connecting means for enabling the assembly to be connected to a supporting structure;

wherein the upper ends of the first and second housing members have hook shaped segments; each segment having hook openings facing in the same rotational direction; and said first and second housing members being rotatable about the shaft axis with respect to each other for movement between (1) an operating position in which the first and second housing members are angularly aligned with each other forming a rope enclosing housing transversely over the sheave with the complementary connecting means being angularly aligned for use in connection with a supporting structure, and (2) a rope loading and unloading position in which the first and second housing members are angularly displaced with respect to each other enabling a looped section of a rope to be easily mounted over or removed from the sheave.

2. The hoisting tackle block assembly as defined in claim 1 wherein each of the housing members are unitary one piece members.

3. The hoisting tackle block assembly as defined in claim 2 wherein the first and second housing members are mirror images of each other.

4. The hoisting tackle block assembly as defined in claim 2 wherein each of the housing members has a main body portion that extends along the sides of the sleeve and an intermediate angular portion that extends upward and inward transversely over the sheave terminating in an upper end.

* * * * *